US009732627B2

(12) United States Patent
Okuno et al.

(10) Patent No.: US 9,732,627 B2
(45) Date of Patent: Aug. 15, 2017

(54) SEALING STRUCTURE IN STEAM TURBINE

(71) Applicant: KABUSHIKI KAISHA TOSHIBA, Minato-ku, Tokyo (JP)

(72) Inventors: Kenichi Okuno, Yokohama (JP); Yoshifumi Iwasaki, Yokohama (JP); Yoriharu Murata, Yokohama (JP); Toshio Hirano, Yokohama (JP); Itaru Murakami, Tokyo (JP); Shinichiro Ohashi, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 596 days.

(21) Appl. No.: 13/955,760

(22) Filed: Jul. 31, 2013

(65) Prior Publication Data

US 2014/0037431 A1 Feb. 6, 2014

(30) Foreign Application Priority Data

Aug. 2, 2012 (JP) ..... 2012-172173

(51) Int. Cl.
*F01D 11/08* (2006.01)
*F01D 25/00* (2006.01)
(Continued)

(52) U.S. Cl.
CPC ..... *F01D 25/007* (2013.01); *F01D 11/08* (2013.01); *F01D 11/16* (2013.01); *F01D 25/24* (2013.01);
(Continued)

(58) Field of Classification Search
CPC ..... F01D 11/00; F01D 11/001; F01D 11/08; F01D 25/24; F01D 25/32; F05D 2220/31; F05D 2260/607; F02C 7/28
See application file for complete search history.

(56) References Cited

U.S. PATENT DOCUMENTS 3,897,169 A * 7/1975 Fowler ..... F01D 11/08 277/419
5,037,114 A * 8/1991 Gray ..... F01D 11/12 277/414
(Continued)

FOREIGN PATENT DOCUMENTS

CH 129679 A * 1/1929 ..... F01D 25/32
EP 2 236 754 A2 10/2010
(Continued)

OTHER PUBLICATIONS

Japanese Office Action, Application No. 2012-172173, dated Jul. 14, 2015 with English Translation, 8 pages.

*Primary Examiner* — Gregory Anderson
*Assistant Examiner* — Christopher R Legendre
(74) *Attorney, Agent, or Firm* — Foley & Lardner LLP

(57) ABSTRACT

According to an embodiment, a rotor blade cover section is integrated with the rotor blades at leading ends thereof. A plurality of sealing fins is disposed at the rotor blade cover section, the sealing fins forming a predetermined clearance relative to an inner peripheral portion of the nozzle outer ring. An annular solid particle trapping space is disposed at the inner peripheral portion of the nozzle outer ring, the solid particle trapping space communicating with an inlet of a steam leak and trapping solid particles that flow in with steam. In the sealing structure, the nozzle outer ring has a through hole through which the solid particles are to be discharged from the solid particle trapping space toward a downstream stage of the steam turbine.

14 Claims, 4 Drawing Sheets

(51) Int. Cl.
*F01D 25/24* (2006.01)
*F01D 25/32* (2006.01)
*F01D 11/16* (2006.01)

(52) U.S. Cl.
CPC ..... *F01D 25/32* (2013.01); *F05D 2220/31* (2013.01); *F05D 2260/607* (2013.01)

(56) References Cited

U.S. PATENT DOCUMENTS 5,271,712 A * 12/1993 Brandon ..... F01D 11/08 277/423
5,494,405 A * 2/1996 Gray ..... F01D 25/32 415/211.2
5,547,340 A * 8/1996 Dalton ..... F01D 11/001 277/412
6,860,718 B2 * 3/2005 Suzuki ..... F01D 5/225 415/173.5
7,296,964 B2 * 11/2007 Montgomery ..... F01D 11/001 415/108
8,714,915 B2 * 5/2014 Blatchford ..... F01D 25/00 415/121.2
9,194,259 B2 * 11/2015 Mitchell ..... F01D 25/32
2007/0071594 A1 3/2007 Montgomery
2008/0118350 A1 5/2008 Feeny et al.
2011/0123313 A1 * 5/2011 Blatchford ..... F01D 25/00 415/121.2
2014/0037431 A1 * 2/2014 Okuno ..... F01D 25/007 415/121.2

FOREIGN PATENT DOCUMENTS

EP 2 236 754 A3 1/2014
FR 2908815 A1 5/2008
GB 1484289 A * 9/1977 ..... F01D 25/32
JP 53074607 A * 7/1978
JP 60184904 A * 9/1985
JP 61-181801 U 11/1986
JP 62168905 A * 7/1987
JP 63117105 A * 5/1988
JP 2003-214113 A 7/2003
JP 2009243287 A * 10/2009
JP 5173646 B2 * 4/2013
WO WO 0177499 A1 * 10/2001 ..... F01D 25/32

* cited by examiner

SEALING STRUCTURE IN STEAM TURBINE

CROSS-REFERENCE TO RELATED APPLICATION

This application is based upon and claims the benefit of priority from Japanese Patent Application No. 2012-172173, filed Aug. 2, 2012, the entire contents of which are incorporated herein by reference.

FIELD

Embodiments described herein relate generally to a sealing structure in a steam turbine.

BACKGROUND

Steam sent from a boiler or other upstream device to a steam turbine contains solid particles and a phenomenon has long been known in which the solid particles in steam erode components of turbine paths. The solid particles causing the erosion are said to originate in a boiler, a reheater, or their piping. In general, the erosion is particularly noticeable in a forward stage of high-pressure and medium-pressure turbines. The erosion may nonetheless extend to a rearward stage of the turbine depending on the size and quantity of the solid particles.

FIG. 7 illustrates a conventionally typical sealing structure in a steam turbine. In FIG. 7, a nozzle 2 allows steam to flow into a rotor blade 1 and the steam rotates the rotor blade 1. A nozzle outer ring 3 constitutes a nozzle diaphragm that is a structural member with which the nozzle 2 is to be mounted on a casing of the steam turbine.

A plurality of nozzle outer ring sealing fins 4 is mounted through, for example, caulking on an inner peripheral surface of the nozzle outer ring 3. The nozzle outer ring sealing fins 4 block steam that may leak through a clearance between a leading end of the rotor blade 1 and the inner peripheral surface of the nozzle outer ring 3.

In FIG. 7, arrows 30 indicate behavior of solid particles 20 that flow in with the steam. A steam flow that goes through the nozzle 2 has a swirl component and thus tends to be deflected to the outer peripheral side. The solid particles 20 that move with such a steam flow also have a swirl component and, moreover, receive a centrifugal force to be directed toward the outer peripheral direction. As illustrated in FIG. 7, the solid particles 20 deflected toward to the outer peripheral direction collide with the inner peripheral surface of the nozzle outer ring 3; in addition, part of the solid particles 20 enters into the clearance between the nozzle outer ring sealing fins 4 and a rotor blade cover section 5.

A material having hardness lower than that of a body of the rotor blade 1 is generally used for the nozzle outer ring sealing fins 4 in order to reduce adverse effects, such as wear, due to their contact with the rotor blade 1. The nozzle outer ring sealing fins 4 are thus more susceptible to erosion by the solid particles 20. When such erosion develops, the gap between the nozzle outer ring sealing fins 4 and the rotor blade cover section 5 is widened. In addition, the caulking member that fixes the nozzle outer ring sealing fins 4 may be eroded, resulting eventually in the nozzle outer ring sealing fins 4 coming off position. Such erosion may reach a rearward stage beyond an inlet stage of a high-pressure/medium-pressure turbine.

A known arrangement for preventing erosion of steam turbine components, such as the nozzle outer ring sealing fins 4, by the solid particles 20 includes, for example, a circumferential collecting path disposed between adjacent turbine stages. The collecting path can remove the solid particles from the steam.

DETAILED DESCRIPTION OF THE PREFERRED EMBODIMENTS

According to an embodiment, a rotor blade cover section is integrated with the rotor blades at leading ends thereof. A plurality of sealing fins is disposed at the rotor blade cover section, the sealing fins forming a predetermined clearance relative to an inner peripheral portion of the nozzle outer ring. An annular solid particle trapping space is disposed at the inner peripheral portion of the nozzle outer ring, the solid particle trapping space communicating with an inlet of a steam leak and trapping solid particles that flow in with steam. In the sealing structure, the nozzle outer ring has a through hole through which the solid particles are to be discharged from the solid particle trapping space toward a downstream stage of the steam turbine.

The sealing structures in steam turbines according to preferred embodiments of the present invention will be described below with reference to the accompanying drawings.

First Embodiment

Figure 1:
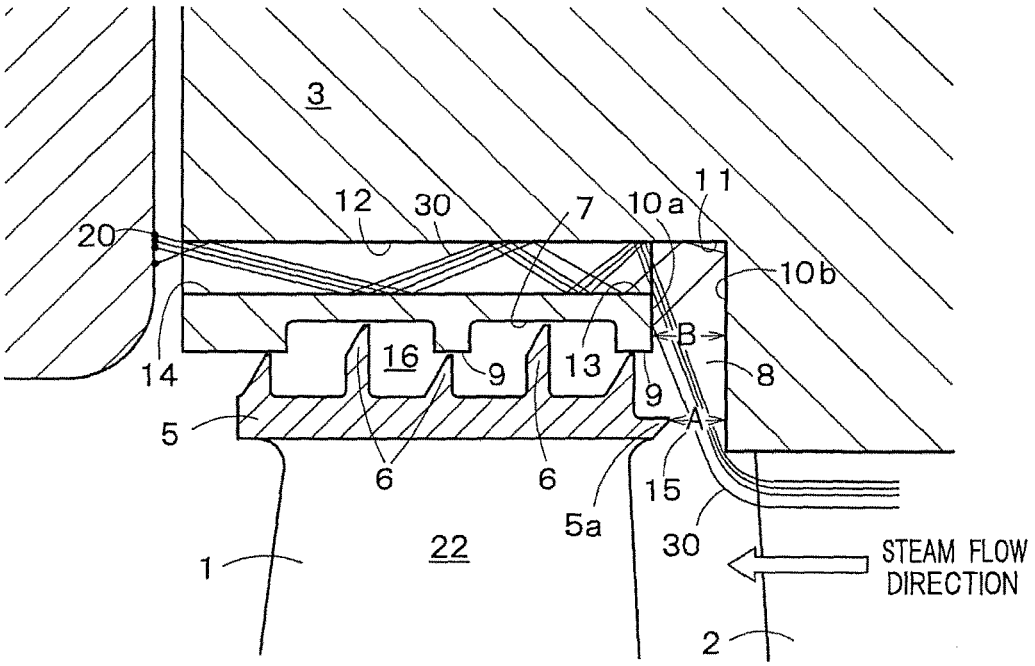
FIG. 1 is a longitudinal cross-sectional view showing a sealing structure in a steam turbine according to a first embodiment of the present invention.

FIG. 1 shows a sealing structure in steam turbine according to a first embodiment of the present invention, In FIG. 1, a rotor blade 1 is rotated with a rotor not shown by steam and constitutes a plurality of turbine stages. A nozzle 2 allows steam to flow in toward the rotor blade 1. A nozzle outer ring 3 constitutes a nozzle diaphragm that is a structural member for fixing the nozzle 2 in a casing of the turbine. In FIG. 1, the blank arrow indicates the flow direction in which steam that works for rotating the rotor blade 1.

A rotor blade cover section 5 is integrally formed with a body of the rotor blade 1. The rotor blade cover section 5 is formed with an axially protruding portion 5*a* at a leading end of the rotor blade 1 in a circumferential direction of the rotor. A clearance generally is defined between an outer peripheral portion of the rotor blade cover section 5 and an inner peripheral surface of the nozzle outer ring 3. The clearance forms a steam leak portion 16. An increase in the amount of steam leaking through the clearance of the steam leak portion 16 is a cause of reduced steam turbine efficiency.

Thus, the sealing structure in a steam turbine according to the first embodiment of the present invention has a plurality of sealing fins 6 integrally formed on the outer peripheral portion of the rotor blade cover section 5 in the circumferential direction of the rotor blade 1. The sealing fins 6 protrude radially from the rotor blade 1. In addition, a predetermined slight amount of clearance is set between the inner peripheral surface of the nozzle outer ring 3, specifically, a sealing fin facing surface 7 and leading ends of the sealing fins 6. This clearance is intended to prevent the sealing fin facing surface 7 from being damaged by the sealing fins 6 that may come into contact with the sealing fin facing surface 7 when the rotor blade 1 is rotated.

In the first embodiment of the present invention, the sealing fins 6 comprise alternately tall and short sealing fins 6. The tall sealing fins 6 is facing opposite to the sealing fin facing surface 7, while the short sealing fins 6 is facing opposite to shoulders 9. The shoulders 9 on the inner peripheral surface of the nozzle outer ring 3 and arrangement of alternately tall and short sealing fins 6 as described above increase resistance in the steam leak 16 to thereby reduce the amount of steam leakage as much as possible.

In the first embodiment of the present invention, the sealing fins 6 are integrally formed with the rotor blade cover section 5. This allows the sealing fins 6 to be formed of a material having high hardness and, as a result, to increase their erosion resistance, unlike a case in which the sealing fins 6 are attached on the inner peripheral surface of the nozzle outer ring 3. In addition, preferably, surface hardness of the sealing fins 6 is enhanced through a surface hardening process, such as quenching and nitriding. Particularly effective is a surface hardening process applied to the sealing fins 6 disposed at an inlet side of the steam leak 16.

In FIG. 1, solid-line arrows 30 indicate behavior of solid particles 20 that are mixed with steam and flow into the rotor blade 1. A steam flow that goes through the nozzle 2 has a swirl component. The solid particles 20 included in the steam flow have a velocity that also has a swirl component. In addition, a centrifugal force acts on the solid particles 20 to cause the solid particles 20 to tend to be directed toward an outer peripheral direction of the rotor blade 1.

The solid particles 20 deflected in the outer peripheral direction may collide with the inner peripheral surface of the nozzle outer ring 3. In addition, part of the solid particles 20 that have collided against and bounced off the inner peripheral surface of the nozzle outer ring 3 can enter the steam leak portion 16 in which the sealing fins 6 are arrayed.

A particle trapping space 8 as detailed below is thus annularly formed at the inlet to the steam leak 16 defined between the rotor blade cover section 5 and the inner peripheral surface of the nozzle outer ring 3.

In FIG. 1, the inner peripheral surface of the nozzle outer ring 3 has side surfaces 10*a*, 10*b* and a peripheral surface 11 formed as surfaces which define the particle trapping space 8. Specifically, the side surfaces 10*a*, 10*b* extend in parallel with a radial direction of the rotor not shown (in the following, the "radial direction" refers to the radial direction of the rotor). The peripheral surface 11 extends in a circumferential direction of a circle having a rotor shaft as its center (in the following, the "circumferential direction" refers to the circumferential direction about the rotor shaft). At an inlet 15 to the steam leak portion 16, let A be a dimension in an axial direction of the rotor (in the following, the "axial direction" refers to the axial direction of the rotor) of a clearance of the narrowest portion between the side surface 10*b* on an upstream side and the rotor blade cover section 5 and let B be a width dimension of the particle trapping space 8 in the axial direction. Then, a relation of A<B holds and the inlet 15 to the steam leak 16 communicates with the annular particle trapping space 8 that expands to have the width dimension B in the axial direction toward the outside in the radial direction. The particle trapping space 8 has a depth in the radial direction defined by a relation between the sealing fin facing surface 7 on the inner peripheral surface of the nozzle outer ring 3 and a portion of the peripheral surface 11 of the nozzle outer ring 3, the portion forming the particle trapping space 8; specifically, the depth of the particle trapping space 8 is defined so that the peripheral surface 11 is disposed outwardly in the radial direction.

In addition, the nozzle outer ring 3 has a through hole 12 extending in the axial direction. The through hole 12 has an inlet 13 opening in the side surface 10*a* that defines the particle trapping space 8 on a downstream side thereof. The through hole 12 has an outlet 14 opening in a downstream end face of the nozzle outer ring 3. The through hole 12 may comprise a plurality of through holes 12 arranged at intervals in the circumferential direction of the nozzle outer ring 3.

The sealing structure in a steam turbine according to the first embodiment of the present invention has the arrangements as described heretofore. Operation and effects of the sealing structure for a steam turbine according to the first embodiment of the present invention will now be described below.

In FIG. 1, the solid particles 20 mixed with the steam and flowing from the nozzle 2 into the rotor blade 1 have the swirl velocity component and, moreover, a centrifugal force exerts on the solid particles 20. Thus, part of the solid particles 20 is deflected toward the outer peripheral side of the rotor blade 1 as indicated by the arrows 30.

The width dimension B in the axial direction of the particle trapping space 8 is wider than the dimension A in the axial direction of the clearance narrowed between the side surface 10*b* and the rotor blade cover section 5. Furthermore, the peripheral surface 11 is set to be disposed outwardly in the radial direction relative to the sealing fin facing surface 7 to thereby extend the depth of the particle trapping space 8 in the radial direction. The particle trapping space 8 having a structure such as that described above causes the solid particles 20 deflected in the radial direction to be guided first into the particle trapping space 8. The solid particles 20, having lost their kinetic energy upon collision against the side surface 10*a* and the peripheral surface 11, are trapped in the particle trapping space 8. Part of the solid particles 20 that has collided against and bounced off the side surfaces 10*a*, 10*b* and the peripheral surface 11 merges with steam that flows into a steam path section 22 of the rotor blade 1.

By disposing the particle trapping space 8 that has a depth increased outwardly in the radial direction on the inlet side of the steam leak 16, a likelihood that the deflected solid particles 20 will directly collide against the sealing fins 6 of the rotor blade cover section 5 can be considerably reduced. As a result, enlargement of the clearance between the leading ends of the sealing fins 6 and the sealing fin facing surface 7 or the shoulders 9 due to erosion by the solid particles 20 can be prevented from occurring.

The solid particles 20 trapped in the particle trapping space 8 are to be guided to a downstream stage side through the through hole 12 in the nozzle outer ring 3, the through hole 12 communicating with a steam turbine on the downstream stage side. In this case, there is a pressure difference across the rotor blade 1 and pressure at the inlet 13 is higher than pressure at the outlet 14 of the through hole 12. This pressure difference promotes discharging of the solid particles 20 trapped in the particle trapping space 8 through the through hole 12. This makes part of the solid particles 20 trapped in the particle trapping space 8 less easy to enter the steam leak 16 through the clearance between the sealing fins 6 and the sealing fin facing surface 7 or the shoulders 9, so that the sealing fins 6 and the sealing fin facing surface 7 can be prevented from being eroded.

Moreover, as a result of repeated collisions against a wall surface of the through hole 12 during their way therethrough, the solid particles 20 have particle diameters smaller at the outlet 14 of the through hole 12 than at the inlet 13. Thus, the solid particles 20, should they flow into the steam turbine at the downstream stage after the through hole 12, give less damage to the sealing fins 6.

The amount of erosion of the sealing fins 6 by the solid particles 20 depends on the particle diameter of the solid particles 20. The larger the particle diameter, the more the amount of erosion is considered to be. If the solid particles 20 having large particle diameters are expected to be mixed with the steam, preferably, the sealing structure according to the first embodiment of the present invention is applied to steam turbines of a plurality of stages.

Second Embodiment

Figure 2:
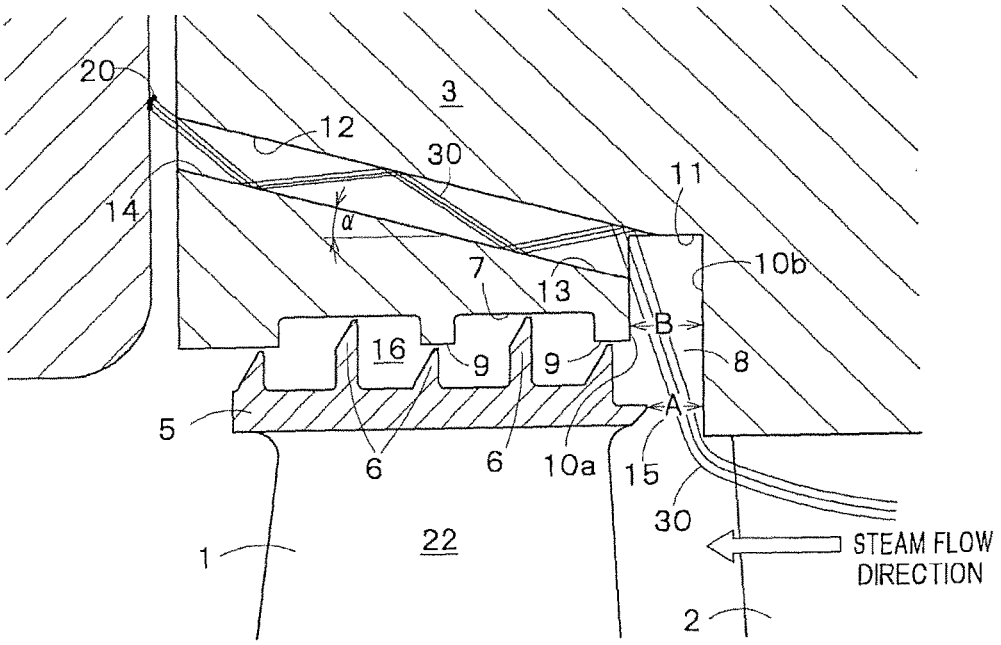
FIG. 2 is a longitudinal cross-sectional view showing a sealing structure in a steam turbine according to a second embodiment of the present invention.

A sealing structure in a steam turbine according to a second embodiment of the present invention will be described below with reference to FIG. 2. In FIG. 2, like or corresponding parts are identified by the same reference numerals as those used for the first embodiment of the present invention shown in FIG. 1 and detailed descriptions for those parts will be omitted.

In the first embodiment of the present invention described above, the through hole 12, through which the solid particles 20 trapped in the particle trapping space 8 are to be discharged, extends in the axial direction of the rotor. In contrast, in the second embodiment of the present invention, a through hole 12 extends in a direction at a predetermined angle relative to the axial direction of the rotor.

In FIG. 2, the through hole 12 has an outlet 14 that is open at a position deviated outwardly in the radial direction of the rotor relative to the position of an inlet 13. Thus, the through hole 12 is configured so as to extend in a position inclined outwardly in the radial direction at a predetermined angle of $\alpha$ relative to the axial direction of the rotor.

Solid particles 20 are affected by a steam flow at an outlet of a nozzle 2 to have a swirl velocity component. Receiving a centrifugal force due to the steam flow, the solid particles 20 have a velocity component causing the solid particles 20 to be oriented toward the outer peripheral side of a nozzle outer ring 3. This makes the solid particles 20 tend more easily to flow through the through hole 12 inclined in the radial direction at the predetermined angle of $\alpha$ relative to the axial direction of the rotor. This enables the solid particles 20 to be discharged even more smoothly toward the rear stage of the turbine without being stagnant in a particle trapping space 8.

The through hole 12 may further be inclined, in addition to the angle $\alpha$ shown in FIG. 2, at an angle in the circumferential direction of the rotor, so that the through hole 12 may be extended in a direction close to a direction in which the swirl velocity component of the solid particles 20 is oriented.

Third Embodiment

Figure 3:
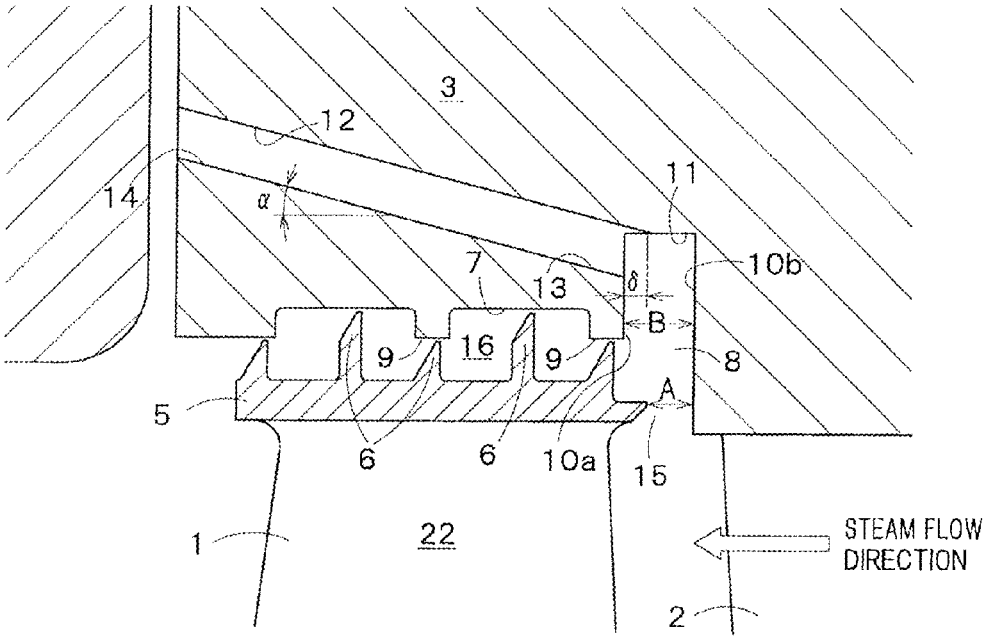
FIG. 3 is a longitudinal cross-sectional view showing a sealing structure in a steam turbine according to a third embodiment of the present invention.

A sealing structure for a steam turbine according to a third embodiment of the present invention will be described below with reference to FIG. 3. In FIG. 3, like or corresponding parts are identified by the same reference numerals as those used for the second embodiment of the present invention shown in FIG. 2 and detailed descriptions for those parts will be omitted.

In the first and second embodiments of the present invention described above, the width dimension B of the particle trapping space 8 is set to be wider than the dimension A of the clearance between the rotor blade cover section 5 and the side surface 10*b* at the inlet 15 to the steam leak 16.

With a long and massive steam turbine, the turbine shaft is largely elongated by heat and the elongation may change the position of the rotor blade 1.

Figure 4:
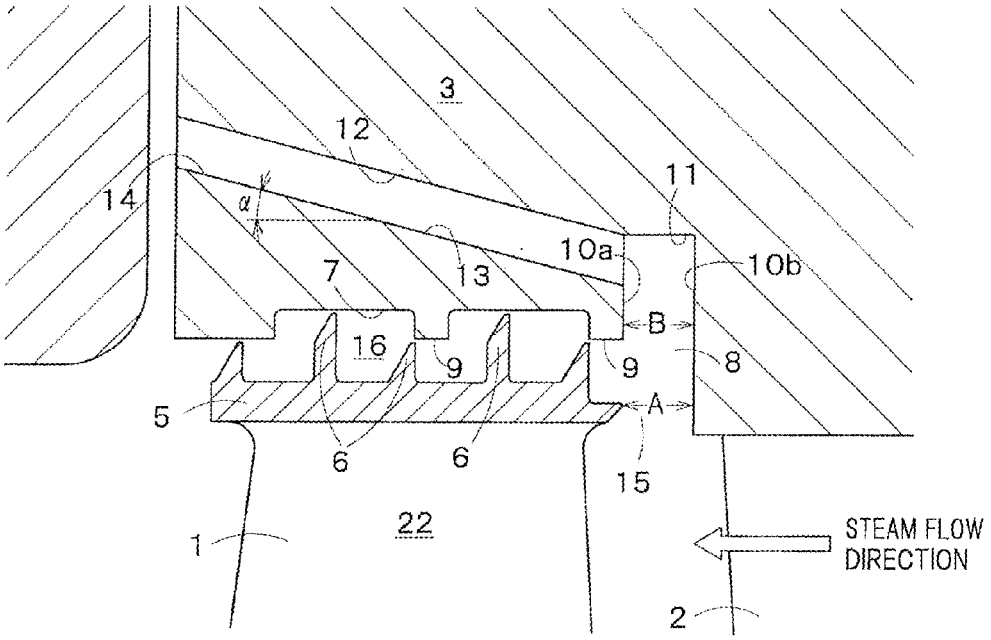
FIG. 4 is a longitudinal cross-sectional view showing the sealing structure in a steam turbine shown in FIG. 2 when a turbine shaft is elongated.

For example, a change in the position of the rotor blade 1 as shown in FIG. 4 may cause the dimension A of the clearance that forms the inlet 15 to the particle trapping space 8 to be larger than the width dimension B of the particle trapping space 8. If this happens, part of the solid particle 20 that has eluded the trap in the particle trapping space 8 can enter the steam leak portion 16 between the rotor blade cover section 5 and the nozzle outer ring 3, thus colliding against the sealing fins 6.

The foregoing situation can be solved by setting a relative positional relation between the rotor blade cover section 5 and the particle trapping space 8 as shown in FIG. 3. Specifically, the position of the side surface 10*a* disposed downstream in the steam flow direction, out of the side surfaces 10*a*, 10*b* that define the particle trapping space 8, is deviated from the position thereof relative to an expected position of the rotor blade cover section 5 during turbine operation a distance $\delta$ that corresponds an estimated elongation of a turbine shaft toward the downstream side in the steam flow direction in an axial direction of the turbine shaft.

By setting such a relative positional relation between the particle trapping space 8 and the rotor blade cover section 5, a likelihood that the solid particles 20 will collide against the sealing fins 6 can be considerably reduced and the solid particles 20 can be reliably trapped in the particle trapping space 8.

Fourth Embodiment

Figure 5:
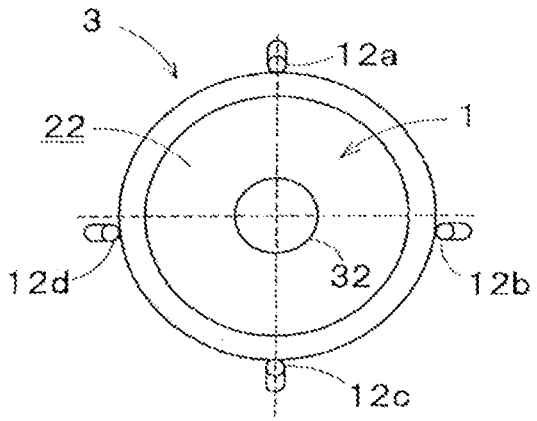
FIG. 5 is a schematic view showing, in a sealing structure in a steam turbine according to a fourth embodiment of the present invention, a relation in positions at which a steam path section and a through hole are disposed when the steam path section across a rotor blade is viewed from an upstream side to a downstream side in a direction in which steam flows.

A sealing structure for a steam turbine according to a fourth embodiment of the present invention will be described below with reference to FIG. 5. In FIG. 5, like or corresponding parts are identified by the same reference numerals as those used for the first to third embodiments of the present invention shown in FIGS. 1 to 3 and detailed descriptions for those parts will be omitted.

FIG. 5 is a schematic view showing a relation in positions at which a steam path section 22 and a through hole 12 are disposed when the steam path section 22 across a rotor blade 1 is viewed from an upstream side to a downstream side in a direction in which steam flows.

In the fourth embodiment of the present invention, a plurality of through holes, in this case, four through holes 12*a* to 12*d* are arranged in the circumferential direction of a nozzle outer ring 3. In the fourth embodiment of the present invention, the through holes 12*a* and 12*c* are disposed on a vertical line that passes through a center of a rotor 32. The through holes 12*b* and 12*d* are disposed at positions slightly below a horizontal line that passes through the center of the rotor 32. These are, however, not the only possible arrangements of the through holes 12*a* to 12*d*.

Of the through holes 12*a* to 12*d*, at least the through hole 12*c* is disposed at a position lower in level than a bottom portion of the steam path section 22 across the rotor blade 1 as shown in FIG. 5. While the sealing structure in a steam turbine according to the fourth embodiment of the present invention has four through holes 12*a* to 12*d*, the number of through holes may be more than four, or the number of through holes may even be two or three. In addition, a plurality of through holes may be disposed below the bottom portion of the steam path section 22.

In addition to the solid particles 20 described with reference to the first to third embodiments of the present invention, water originated from condensed steam while the steam turbine remains stationary is another major cause of eroding the sealing fins 6 arranged at the rotor blade cover section 5. Water, if it remains stagnant in the steam path section 22 across the rotor blade 1 that remains stationary, can erode the sealing fins 6.

In the sealing structure according to the fourth embodiment of the present invention, the through hole 12*c*, unlike the through hole 12*a*, 12*b* and 12*d*, is disposed at a lower level than the bottom portion of the steam path section 22 across the rotor blade 1. This allows the condensate water across the rotor blade 1 to be discharged from the particle trapping space 8 through the through hole 12*c* without being stagnant in the steam path section 22. Erosion of the sealing fins 6 can thus be prevented.

Fifth Embodiment

Figure 6:
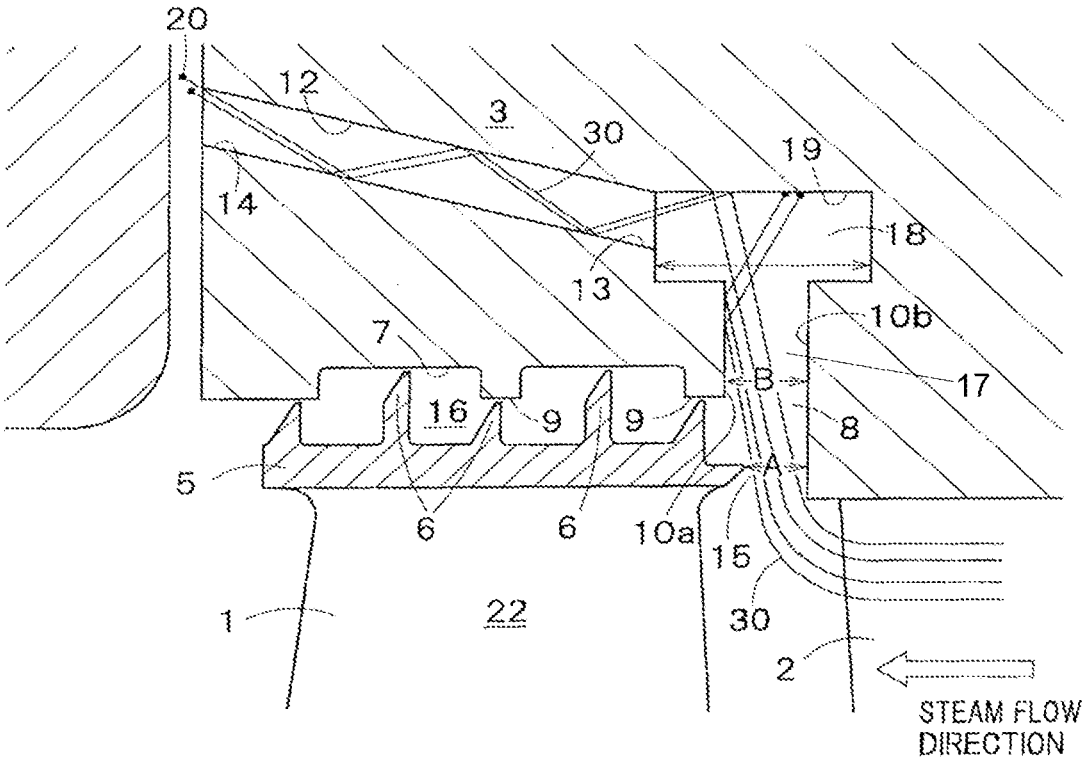
FIG. 6 is a longitudinal cross-sectional view showing a sealing structure in a steam turbine according to a fifth embodiment of the present invention.
Figure 7:
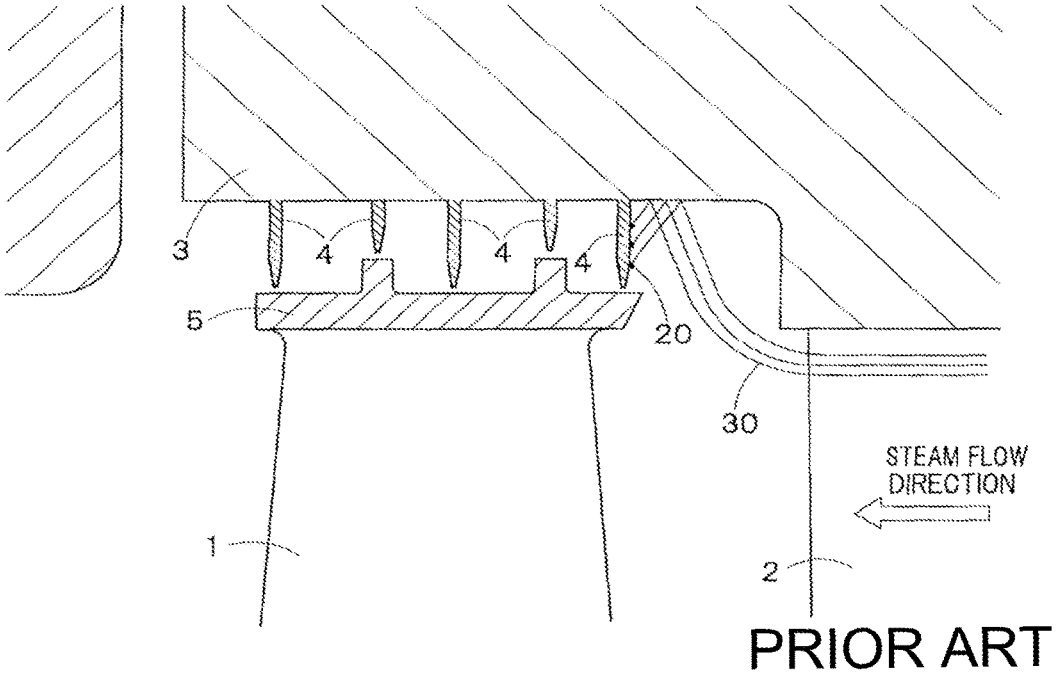
FIG. 7 is a longitudinal cross-sectional view showing a related-art sealing structure in a steam turbine.

FIG. 6 shows a sealing structure in a steam turbine according to a fifth embodiment of the present invention. In FIG. 6, like or corresponding parts are identified by the same reference numerals as those used for the second embodiment of the present invention shown in FIG. 2 and detailed descriptions for those parts will be omitted.

In the fifth embodiment of the present invention, a particle trapping space 8 for trapping the solid particles 20 has an annular two-stage structure having an interior enlarged relative to an inlet.

In FIG. 6, the particle trapping space 8 includes an annular first trapping space 17 and an annular second trapping space 18. The first trapping space 17 is disposed on the inlet side. The second trapping space 18 extends continuously from the first trapping space 17 toward the outside in the radial direction of the rotor.

In the first trapping space 17, let A be a dimension of the narrowest clearance between a side surface 10*b* and a rotor blade cover section 5 and let B be a width dimension of the first trapping space 17. Then, a relation of A<B holds and the first trapping space 17 forms an annular groove having a width in the axial direction of the rotor wider than a clearance at an inlet 15 to a steam leak portion 16.

The first trapping space 17 leads to the second trapping space 18 that has a larger width dimension C to thereby have a greater capacity. The particle trapping space 8 has a depth which is set so that, as in the first to fourth embodiments of the present invention, a circumferential surface 19 forming the second trapping space 18 is disposed outwardly in the radial direction of the rotor relative to a sealing fin facing surface 7 on an inner peripheral portion of a nozzle outer ring 3.

As in the first through the fourth embodiment of the present invention, the nozzle outer ring 3 has a plurality of through holes 12. Each of the through holes 12 has an inlet 13 communicating with the second trapping space 18 and an outlet 14 opened in an end face on the downstream side of the nozzle outer ring 3. As in the second embodiment of the present invention, the through hole 12 is configured to extend with an inclination outwardly in the radial direction at an angle of $\alpha$ relative to the axial direction of the rotor. In addition, the through hole 12 may further be inclined, in addition to the angle $\alpha$, at an angle in the circumferential direction of the rotor.

Operation of the fifth embodiment of the present invention having the arrangements as described above will be described below.

The solid particles 20 that have flowed in, being deflected toward to the outside in the radial direction of the rotor, are guided into the first trapping space 17 as shown in FIG. 6, without flowing into the steam leak 16 at which the sealing fins 6 are arrayed at the rotor blade cover section 5.

In the first trapping space 17, the width dimension B between the side surface 10*a* and the side surface 10*b* is wider than the dimension A of the narrowest clearance between the side surface 10*b* and the rotor blade cover section 5 at the inlet 15. Thus, the deflected solid particles 20, after having been guided into the first trapping space 17, collide against the side surface 10*a* to thereby flow into the second trapping space 18, or directly flow into the second trapping space 18.

The second trapping space 18 has a capacity that is considerably larger than that of the first trapping space 17. Upon flowing into the second trapping space 18, the solid particles 20 are decelerated and thus easily trapped in the second trapping space 18.

In addition, a pressure difference existing across the rotor blade 1 makes pressure at the inlet 13 higher than pressure at the outlet 14 of the through hole 12. This pressure difference promotes discharge of the solid particles 20 trapped in the second trapping space 18 through the through hole 12. Part of the solid particles 20 collected in the particle trapping space 8 therefore does not enter the steam leak portion 16 through the clearance between the sealing fins 6 and the sealing fin facing surface 7 or shoulders 9, and thereby the sealing fins 6 can be prevented from erosion.

According to the sealing structure in a steam turbine according to at least one of the preferred embodiments of the present invention described heretofore, due to arrangement of the particle trapping space 8 that has a depth increased outwardly in the radial direction on the inlet side of the steam leak portion 16, the damage of the nozzle outer ring sealing fins 6 by the solid particles 20 that have flowed in with the steam can be prevented.

While certain preferred embodiments have been described, these embodiments have been presented by way of example only, and are not intended to limit the scope of the inventions. Indeed, the novel methods and systems described herein may be embodied in a variety of other forms; furthermore, various omissions, substitutions, and changes in the form of the methods and systems described herein may be made without departing from the spirit of the inventions. The accompanying claims and their equivalents are intended to cover such forms or modifications as would fall within the scope and spirit of the inventions.

What is claimed is:

1. A sealing structure in a steam turbine, for sealing a steam leak portion formed between tip ends of a plurality of rotor blades rotating with a rotor and an inner peripheral surface of a nozzle outer ring, the sealing structure comprising:

rotor blade cover sections integrated with the rotor blades at the tip ends thereof, respectively, each rotor blade cover section having a protruding portion extending in an axial direction of the rotor;

a plurality of sealing fins disposed at each rotor blade cover section, each fin including a tip portion that defines a clearance between a sealing fin facing surface of the nozzle outer ring and the tip portion of each sealing fin; and an annular solid particle trapping space disposed at the inner peripheral surface of the nozzle outer ring and communicating with an inlet of the steam leak portion, for trapping solid particles that flow in with steam, the annular solid particle trapping space having a pair of surfaces extending in a radial direction of the rotor, the pair of surfaces including a first surface parallel to a second surface, wherein a clearance in the axial direction of the rotor is defined between the first surface of the annular solid particle trapping space and each protruding portion, the nozzle outer ring has a through hole through which the solid particles are to be discharged from the solid particle trapping space toward a downstream stage of the steam turbine, and a width dimension (B) of a clearance in the axial direction of the rotor formed between the first surface and the second surface of the solid particle trapping space is set to be greater than a width dimension (A) of the clearance in the axial direction of the rotor formed between the first surface of the annular solid particle trapping space and each protruding portion at the inlet of the steam leak portion, and a portion of the inner peripheral surface of the nozzle outer ring that extends in the axial direction of the rotor where the solid particle trapping space is formed is set to be disposed outwardly in the radial direction of the rotor relative to the sealing fin facing surface on the nozzle outer ring.

2. The sealing structure in a steam turbine according to claim 1, wherein the first surface is an upstream side surface and the second surface is a downstream side surface with respect to a steam flow direction in the axial direction of the rotor, and the downstream side surface is disposed at a position deviated relative to the rotor blade cover sections by a distance that corresponds to a predetermined elongation of a turbine shaft during turbine operation toward a downstream side of the steam flow direction.

3. The sealing structure in a steam turbine according to claim 2, wherein the through hole has an outlet opening at a position deviated outwardly in the radial direction of the rotor relative to an inlet thereof, and the through hole extends at a predetermined angle inclined relative to the axial direction of the rotor.

4. The sealing structure in a steam turbine according to claim 2, wherein the through hole comprises a plurality of through holes arranged in a circumferential direction of the nozzle outer ring, and at least one of the through holes is disposed at a position lower in level than a bottom of a steam path section across the rotor blades.

5. A steam turbine comprising:

a plurality of turbine stages, at least one of the turbine stages having a sealing structure according to claim 2.

6. The sealing structure in a steam turbine according to claim 1, wherein the through hole has an outlet opening at a position deviated outwardly in the radial direction of the rotor relative to an inlet thereof, and the through hole extends at a predetermined angle inclined relative to the axial direction of the rotor.

7. A steam turbine comprising:

a plurality of turbine stages, at least one of the turbine stages having a sealing structure according to claim 6.

8. The sealing structure in a steam turbine according to claim 1, wherein the through hole comprises a plurality of through holes arranged in a circumferential direction of the nozzle outer ring, and at least one of the through holes is disposed at a position lower in level than a bottom of a steam path section across the rotor blades.

9. A steam turbine comprising:

a plurality of turbine stages, at least one of the turbine stages having a sealing structure according to claim 8.

10. A steam turbine comprising:

a plurality of turbine stages, at least one of the turbine stages having a sealing structure according to claim 1.

11. A sealing structure in a steam turbine, for sealing a steam leak portion formed between tip ends of a plurality of rotor blades rotating with a rotor and an inner peripheral surface of a nozzle outer ring, the sealing structure comprising:

rotor blade cover sections integrated with the rotor blades at the tip ends thereof, respectively, each rotor blade cover section having a protruding portion extending in an axial direction of the rotor;

a plurality of sealing fins disposed at each rotor blade cover section, each fin including a tip portion that defines a clearance between a sealing fin facing surface of the nozzle outer ring and the tip portion of each sealing fin; and an annular solid particle trapping space disposed at the inner peripheral surface of the nozzle outer ring and communicating with an inlet of the steam leak portion, for trapping solid particles that flow in with steam, wherein the nozzle outer ring has a through hole through which the solid particles are to be discharged from the solid particle trapping space toward a downstream stage of the steam turbine, the solid particle trapping space communicates with the inlet of the steam leak portion, the solid particle trapping space has a two-stage structure comprising a first trapping space and a second trapping space, the first trapping space having a pair of surfaces extending in a radial direction of the rotor, the pair of surfaces including a first surface parallel to a second surface, the first trapping space having a width dimension (B) of a clearance in the axial direction of the rotor formed between the first surface and the second surface of the first trapping space set to be greater than a width dimension (A) of a clearance formed in the axial direction between the first surface of the first trapping space and each protruding portion, and the second trapping space extending continuously from the first trapping space outwardly in the radial direction of the rotor and communicating with the through hole, and the second trapping space has a capacity larger than the first trapping space.

12. The sealing structure in a steam turbine according to claim 11, wherein the through hole has an outlet opening at a position deviated outwardly in the radial direction of the rotor relative to an inlet thereof, and the through hole extends at a predetermined angle inclined relative to the axial direction of the rotor.

13. The sealing structure in a steam turbine according to claim 11, wherein the through hole comprises a plurality of through holes arranged in a circumferential direction of the nozzle outer ring, and at least one of the through holes is disposed at a position lower in level than a bottom of a steam path section across the rotor blades.

14. A steam turbine comprising:

a plurality of turbine stages, at least one of the turbine stages having a sealing structure according to claim 11.

* * * * *